US012623811B2

(12) United States Patent
Whitta et al.

(10) Patent No.: US 12,623,811 B2
(45) Date of Patent: May 12, 2026

(54) STACKABLE STORAGE CRATE

(71) Applicant: CREATIVE PLASTIC CONCEPTS, LLC, Sycamore, OH (US)

(72) Inventors: Jacob H. Whitta, Bluffton, OH (US); Ben Sayalith, Findlay, OH (US); Eric Hummel, Findlay, OH (US); Tony Vilay, Findlay, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 89 days.

(21) Appl. No.: 17/983,271

(22) Filed: Nov. 8, 2022

(65) Prior Publication Data

US 2023/0142142 A1 May 11, 2023

Related U.S. Application Data

(60) Provisional application No. 63/277,270, filed on Nov. 9, 2021.

(51) Int. Cl.
*B65D 21/02* (2006.01)

(52) U.S. Cl.
CPC ..... *B65D 21/0213* (2013.01)

(58) Field of Classification Search
CPC ..... B65D 21/0213; B65D 21/023
USPC ..... 206/503
See application file for complete search history.

(56) References Cited

U.S. PATENT DOCUMENTS

| | | | | |
|---|---|---|---|---|
| 3,420,402 | A * | 1/1969 | Frater | B65D 21/045 206/520 |
| 3,430,806 | A * | 3/1969 | Munk | B65D 21/045 206/511 |
| D348,343 | S * | 6/1994 | Lang-Ree | D3/321 |
| D801,686 | S | 11/2017 | Park | |
| D844,988 | S | 4/2019 | Reinhart et al. | |
| 10,894,631 | B2 | 1/2021 | Reinhart et al. | |
| 2014/0083896 | A1 | 3/2014 | Park | |
| 2016/0345545 | A1* | 12/2016 | Huisinga | A01K 31/04 |
| 2017/0137175 | A1 | 5/2017 | Park | |
| 2019/0300239 | A1* | 10/2019 | Reinhart | B65D 21/0209 |

* cited by examiner

*Primary Examiner* — Andrew D Perreault
(74) *Attorney, Agent, or Firm* — Thompson Coburn LLP

(57) ABSTRACT

A stackable storage crate has a main body with a first side wall, a second side wall, a front wall, and a rear wall, an upper section, and a bottom section. The upper section has a top lip and an inner surface. The inner surface has a repeating sequence of lands and channels. The bottom section has a ridge with a matching shape that corresponds with and is configured to be disposed adjacent the repeating sequence of lands and channels of the inner surface of another stackable storage crate when in a stacked assembly.

11 Claims, 11 Drawing Sheets

STACKABLE STORAGE CRATE

CROSS REFERENCE TO RELATED APPLICATIONS

This application claims the benefit of U.S. Provisional Application Ser. No. 63/277,270, filed on Nov. 9, 2021. The entire disclosure of the above application is hereby incorporated herein by reference.

FIELD

The present disclosure relates generally to storage crates and, more particularly, to stackable storage crates.

INTRODUCTION

This section provides background information related to the present disclosure which is not necessarily prior art.

Storage crates are commonly used in residential, and commercial settings to store objects like files, supplies, office materials, recreational equipment, or food. Often, multiple storage crates are used in a single setting together, so storage crates that can be stored in an organized and stable configuration are ideal. Storage crates are also commonly used in settings where the capability to transport many stored objects at once is necessary, and efficient. Such storage crates may be stored and transported in various arrangements, for example, by stacking storage crates on top of one another.

However, some storage crates lack the stability required to stack with other storage crates. Further, some storage crates may not be configured to hold each other in place while in a stacked formation during transport, which may result in broken items, and additional hassle. Using storage crates to store, and transport items effectively is further complicated by the integrity of a storage crate's handles. Storage crates are often used to carry heavy items, and handles may break after continued or strenuous use, reducing user satisfaction.

Accordingly, there is a continuing need for an improved stackable storage crate that is durable, and which is easily stored and transported in stacked formations in combination with other stackable storage crates. Desirably, the storage crate is constructed with a main body configured to support stable stacking, with extra support of the main body, and durable handles.

SUMMARY

In concordance with the instant disclosure, a durable stackable storage crate that can be easily stored and transported in stacked formations in combination with other storage crates, and which is constructed with a main body configured to support stable stacking, with extra support of the main body, and durable handles, has surprisingly been discovered.

In one embodiment, a stackable storage crate has a main body with a first side wall, a second side wall, a front wall, and a rear wall, an upper section, and a bottom section. The upper section has a top lip and an inner surface. The inner surface has a repeating sequence of lands and channels. The bottom section has a ridge with a matching shape that corresponds with and is configured to be disposed adjacent the repeating sequence of lands and channels of the inner surface of another stackable storage crate when in a stacked assembly.

In another embodiment, a stacked assembly is provided by a stackable storage crate being disposed on another stackable storage crate. Each of the stackable storage crate and the another stackable storage crate has a main body with a first side wall, a second side wall, a front wall, and a rear wall, an upper section, and a bottom section. The upper section has a top lip and an inner surface. The inner surface has a repeating sequence of lands and channels. The bottom section has a ridge with a matching shape. The stackable storage crate also abuts the another stackable storage crate. The matching shape of the ridge of the stackable storage crate corresponds with and is disposed adjacent the repeating sequence of lands and channels of the inner surface of the another stackable storage crate.

In a further embodiment, a method of forming a stacked assembly of storage crates includes a step of providing the stackable storage crate and the another stackable storage crate as described. The method further includes a step of aligning the stackable storage crate with the another stackable storage crate. The stackable storage crate is then disposed in a next step on the another stackable storage crate such that the stackable storage crate abuts the another stackable storage crate. The matching shape of the ridge of the stackable storage crate corresponds with and is disposed adjacent the repeating sequence of lands and channels of the inner surface of the another stackable storage crate. Advantageously, the placement of the ridge of the stackable storage crate relative to the inner surface of the upper section of the another stackable storage crate thereby militates against lateral movement of the stackable storage crate relative to the another stackable storage crate in both a side-to-side direction and a forward-to-backward direction.

In yet one more embodiment, a storage crate has a main body including a first side wall, a second side wall, a front wall, a rear wall, a bottom section, and an upper section. The storage crate includes a plurality of support panels, a plurality of horizontal supports, a plurality of vertical supports, and a bottom section ridge. The storage crate further includes at least one handle.

In yet another embodiment, one or more of the first side wall, the second side wall, the front wall, and the rear wall may have the plurality of support panels extending outwardly from the main body of the storage crate. In certain embodiments, the support panels form also a plurality of corner sections in the main body of the storage crate.

In yet a further embodiment, the handles may be formed in at least one of the first side wall, the second side wall, the front wall, and the rear wall. In certain embodiments, the handle may be formed in the upper section of the storage crate. The handle may be integral with or connected to the main body of the storage crate.

In certain embodiments, at least one opening may be formed adjacent the handle in one or more of the first side wall, the second side wall, the front wall, and the rear wall.

In other embodiments, the upper section of the main body may form a portion of the handle in combination with one or more of the first side wall, the second side wall, the front wall, and the rear wall. The handle may have a hollow section disposed between the first horizontal support and the second horizontal support of the upper section. The hollow section may include a plurality of support ridges extending from the first horizontal support to the second horizontal support. The support ridges may be adapted to provide additional support to the handle during lifting and transport of the storage crate.

In further embodiments, a first handle and a second handle may be disposed on opposite sides of the of the main body of the storage crate. The first and second handle may be configured to provide an ergonomic location for a user to lift the main body of the storage crate.

In an exemplary embodiment, the storage crate includes a main body. The main body of the storage crate may be constructed using any durable, rigid material. As one non-limiting example, plastic may be used. However, one skilled in the art may select any suitable material for fabricating the storage crate. The storage crate may be any suitable size and shape, as desired. In certain embodiments, the storage crate has a substantially rectangular shape, as one non-limiting example.

According to certain embodiments, the main body of the storage crate may have a first side wall, a second side wall, a front side wall, and a rear side wall. The storage crate may further include a bottom section and an upper section, according to certain embodiments. The first side wall, the second side wall, the front side wall, the rear side wall, the bottom section, and the upper section may be integrally formed with one another, separate components connected to one another, or a combination of the two.

One or more of the first side wall, the second side wall, the front side wall, and the rear side wall may have a plurality of support panels extending outwardly from the main body of the storage crate. The support panels may provide additional storage space, as well as structural support for the storage crate. In certain embodiments, the support panels also form a plurality of corner sections in the main body of the storage crate.

A plurality of horizontal supports may be disposed adjacent one or more of the first side wall, the second side wall, the front side wall, and the rear side wall, according to certain embodiments. The horizontal supports may be ledges extending outwardly from the main body of the storage crate between some or each of the support panels, as one non-limiting example. Any suitable supports may be used to increase stability of the storage crate, as determined by one of skill in the art.

A plurality of vertical supports may also be disposed on the main body of the storage crate. The vertical supports may extend downwardly from the upper section of the main body along one or more of the first side wall, the second side wall, the front side wall, and the rear side wall. The vertical supports may extend outwardly from the first side wall, the second side wall, the front side wall, and the rear side wall, according to certain embodiments. In certain embodiments, the vertical supports may extend from the upper section to the bottom section of the storage crate. In certain embodiments, the vertical supports may also be disposed on one or more of the corner sections of the storage crate.

The bottom section of the storage crate may be a flat, rigid surface disposed adjacent a first end of each of the first side wall, the second side wall, the front side wall, and the rear side wall. The bottom section, according to certain more particular embodiments, may include a bottom section ridge extending downwardly away from a bottom surface of the bottom section of the storage crate. The bottom section ridge may be a ridge having any desired shape and size. The bottom section ridge may be continuous, or broken up in sections. In certain embodiments, the bottom section ridge may have a grid-like configuration, as one non-limiting example.

The upper section may form a portion of the first side wall, the second side wall, the front side wall, and the rear side wall, may be a separate component adjacent a second end of each of the first side wall, the second side wall, the front side wall, and the rear side wall, or may be a combination of the two. In certain more particular embodiments, the upper section may include a first horizontal support and a second horizontal support below the first horizontal support. The second horizontal support may be disposed adjacent each of the first side wall, the second side wall, the front side wall, and the rear side wall and extend outwardly from the main body of the storage crate. The upper section may also include one or more upper section vertical supports extending from the first horizontal support to the second horizontal support, as desired. The upper section, according to certain embodiments, may include upper section corner sections.

In certain embodiments, the main body may include at least one handle. The handle may be formed in at least one of the first side wall, the second side wall, the front side wall, and the rear side wall. In certain embodiments, the handle may be formed in the upper section of the storage crate. The handle may be integral with or connected to the main body of the storage crate. The handle may be any ergonomic size and shape suitable for allowing a user to tightly grasp and transport the storage crate, as needed.

In certain more particular embodiments, at least one opening may be formed adjacent the handle in one or more of the first side wall, the second side wall, the front side wall, and the rear side wall. The opening may be any suitable shape and size allowing a user to insert a hand through the opening to easily grasp the handle.

In certain more particular embodiments, the upper section of the main body may form a portion of the handle in combination with one or more of the first side wall, the second side wall, the front side wall, and the rear side wall. The handle may have a hollow section disposed between the first horizontal support and the second horizontal support of the upper section, according to certain embodiments. The hollow section may include a plurality of support ridges extending from the first horizontal support to the second horizontal support. The support ridges may be adapted to provide additional support to the handle during lifting and transport of the storage crate.

In certain more particular embodiments, a first handle and a second handle may be disposed on opposite sides of the of the main body of the storage crate. As a non-limiting example, the first handle may be disposed adjacent the front side wall, and the second handle may be disposed adjacent the rear side wall. The first and second handles may be configured to provide an ergonomic location for a user to lift the main body of the storage crate. One skilled in the art may select any type and number of handles disposed on any portion of the storage crate, within the scope of the present disclosure.

In use, the support panels, the horizontal supports, the vertical supports, the corner sections, and the upper section corner sections are adapted to provide additional support to the storage crate. When the storage crate is stacked on or below another storage crate, the bottom section ridge of one storage crate, fits recessed in between the first side wall, the second side wall, the front side wall, and the rear side wall of another storage crate. Likewise, according to certain embodiments, the bottom surface of the bottom section of one storage crate rests adjacent the upper section of another storage crate, or more specifically, the first horizontal support of the upper section of another storage crate, according to certain embodiments. Accordingly, when stacked in combination, each storage crate has optimal support and optimal stability during use.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a top perspective view of the stackable storage crate;

FIG. 2. is a bottom perspective view of the stackable storage crate shown in FIG. 1;

Figure 1:
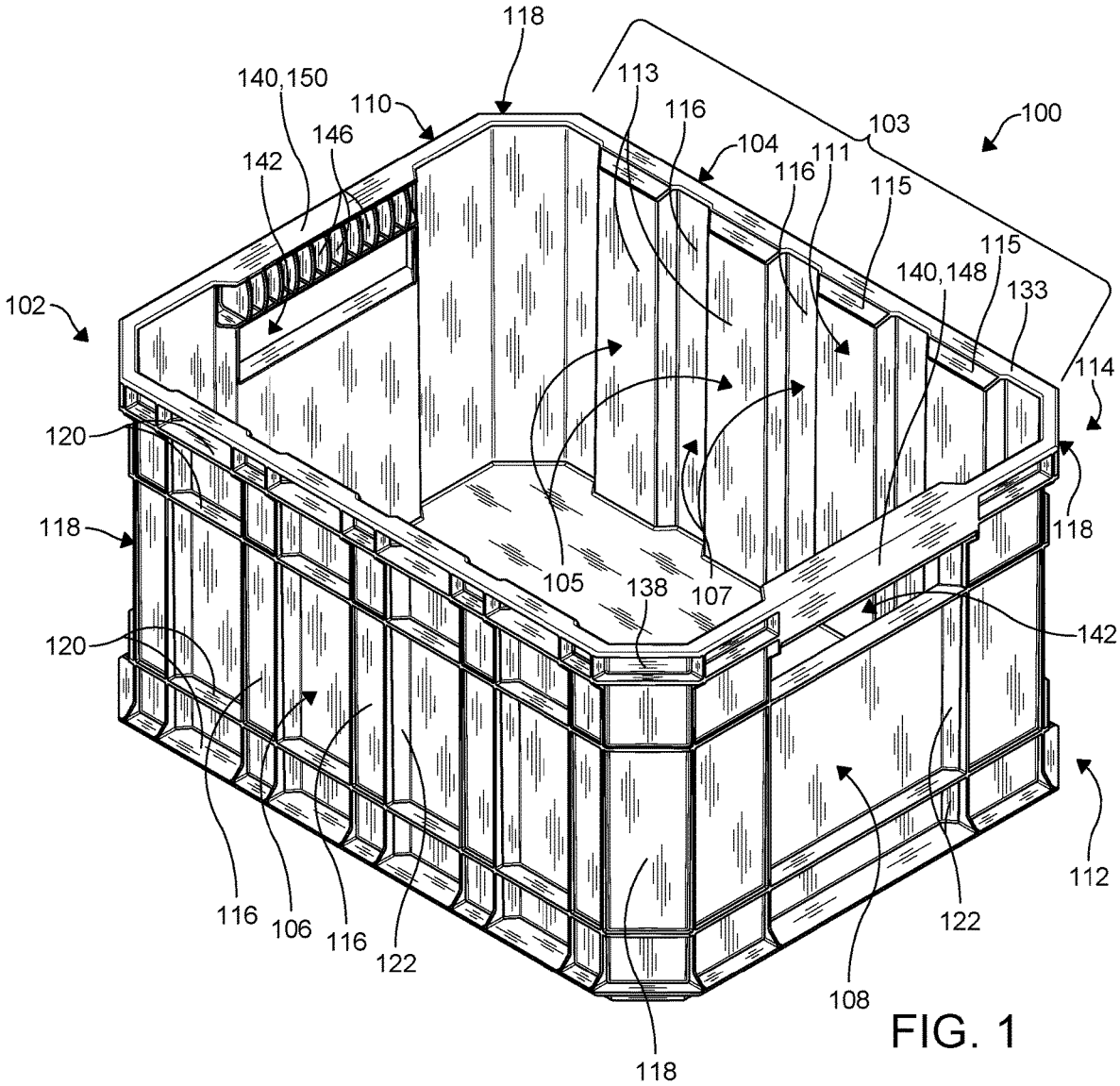
Figure 9:
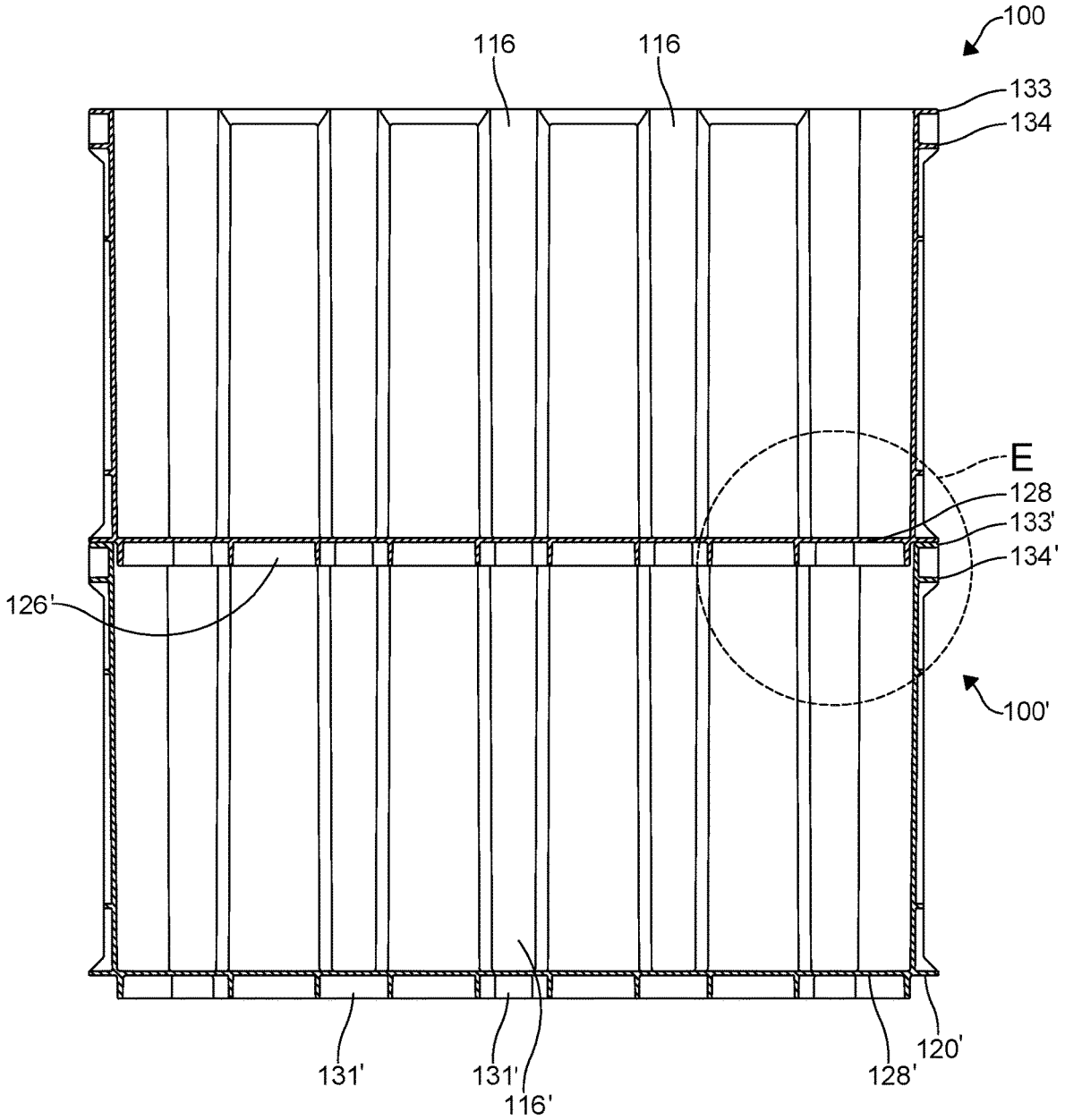
FIG. 9 is a cross-sectional right side elevational view of the pair of stackable storage crates depicted stacked together and taken at section line A-A in FIG. 8.
Figure 10:
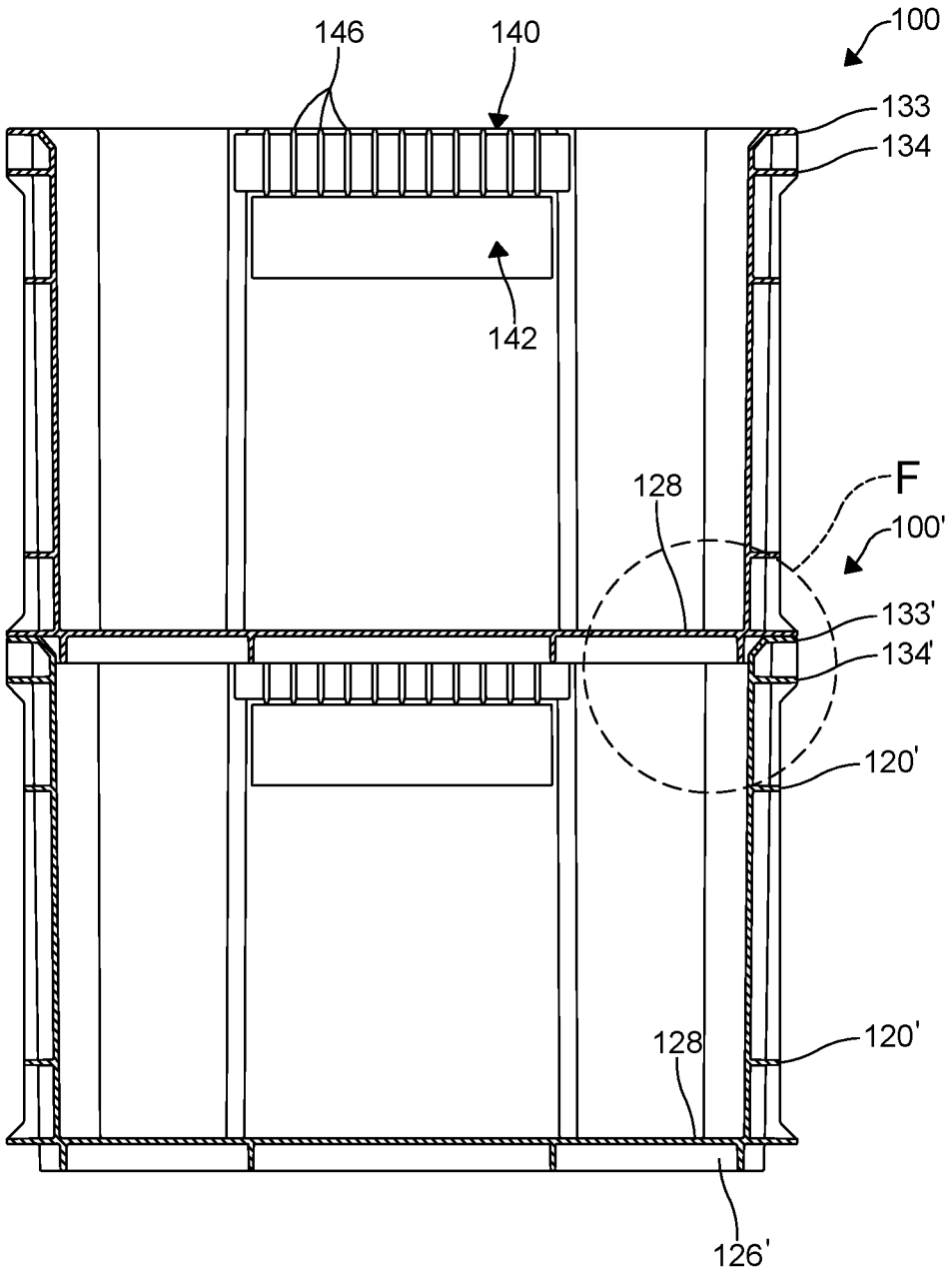
FIG. 10 is a cross-sectional front side elevational view of the pair of stackable storage crates depicted stacked together and taken at section line B-B in FIG. 8.
Figure 13:
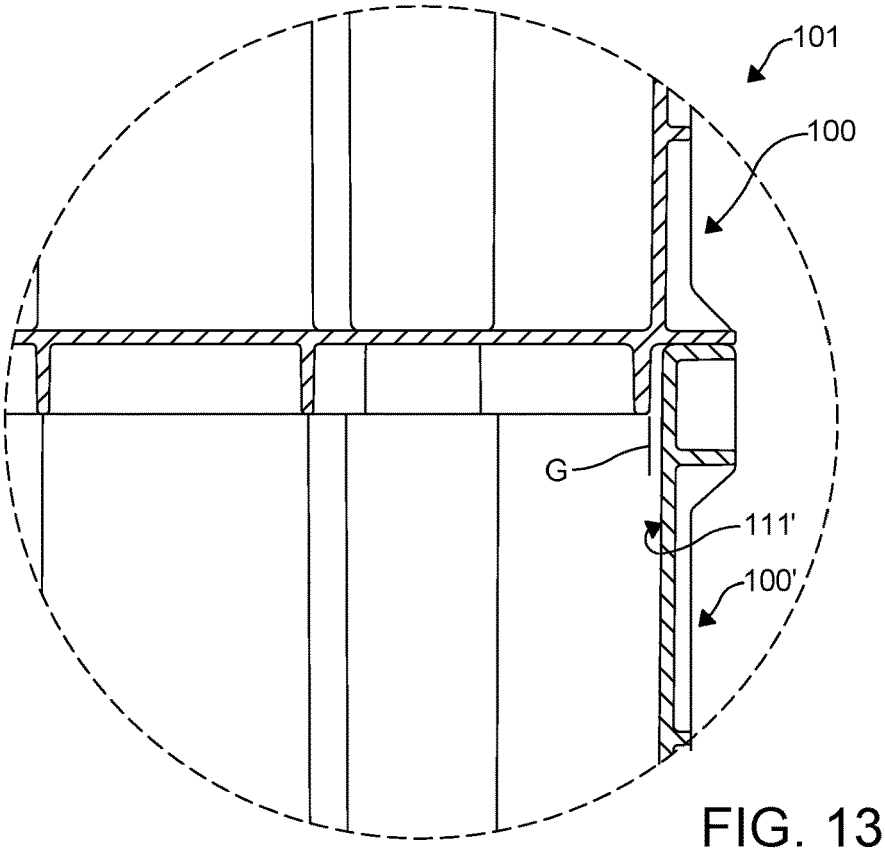
Figure 14:
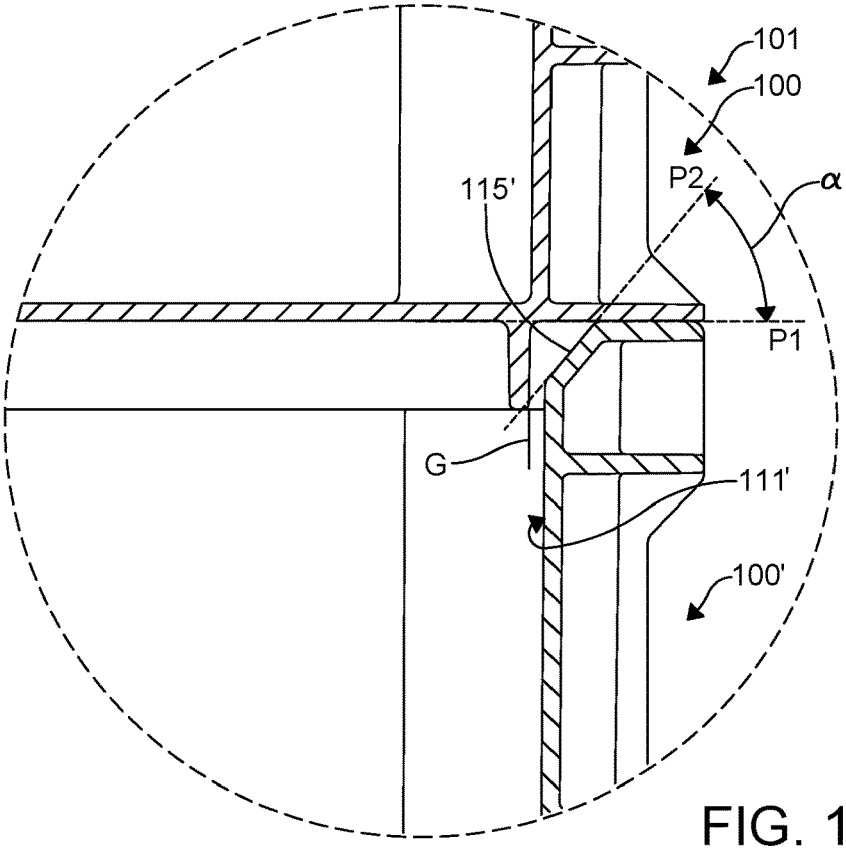
Figure 15:
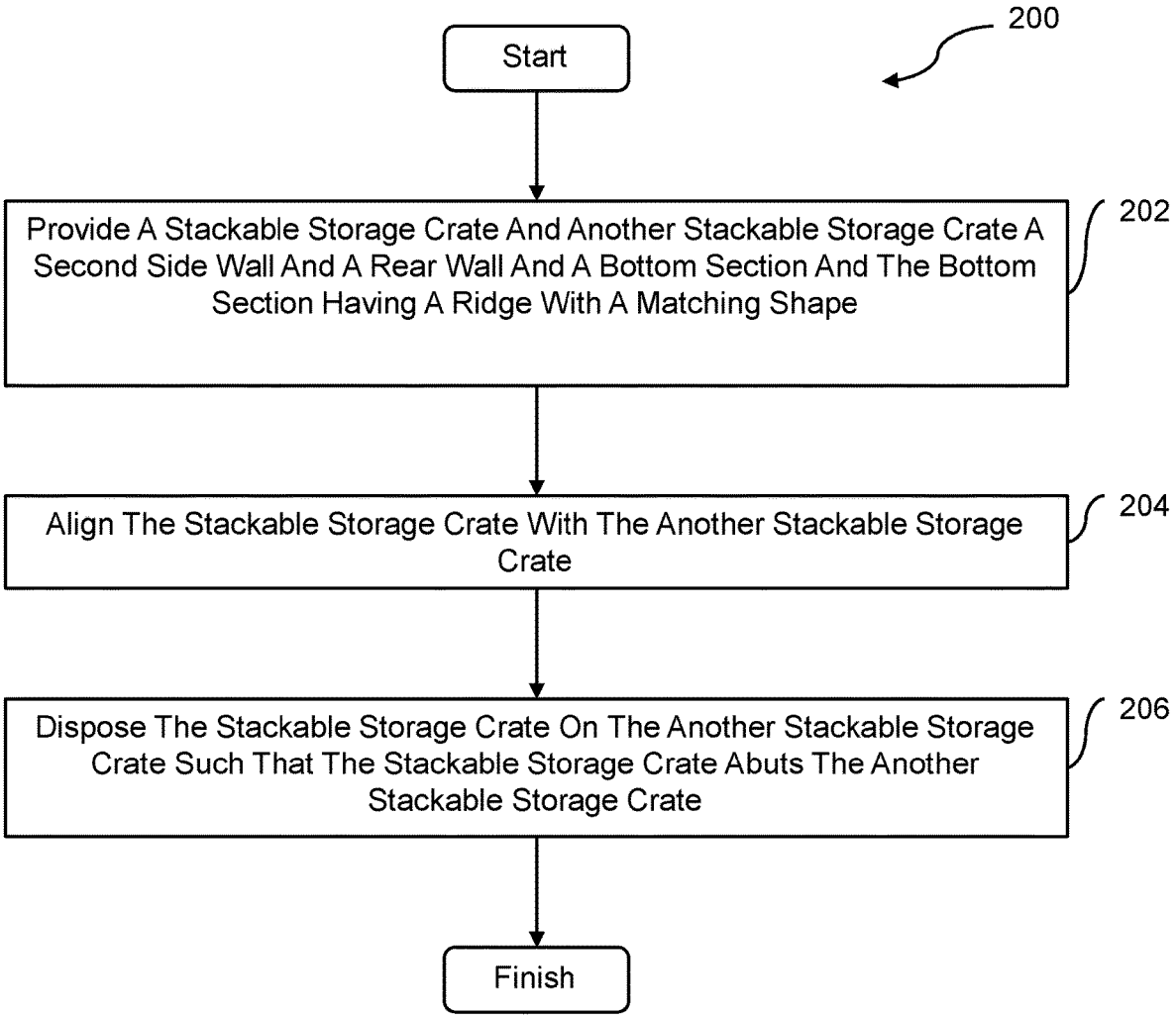

FIG. 13 is an enlarged, fragmentary, cross-sectional right side elevational view of the pair of stackable storage crates taken at callout E in FIG. 9, and further illustrating a consistent gap G between the ridge of one of the storage crates and the inner surface of the top section of another of the storage crates when the storage crates are aligned and nested with one another in the stacked assembly;

FIG. 14 is an enlarged, fragmentary, cross-sectional front side elevational view of the pair of stackable storage crates taken at callout F in FIG. 10, and further illustrating the consistent gap G between the ridge of one of the storage crates and the inner surface of the top section of another of the storage crates when the storage crates are aligned and nested with one another in the stacked assembly; and FIG. 15 is a flow diagram illustrating a method of forming a stacked assembly of the storage crates shown in FIG. 1, according to one embodiment of the present disclosure

DETAILED DESCRIPTION

The following description of technology is merely exemplary in nature of the subject matter, manufacture, and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As shown in FIGS. 1-14, the storage crate 100 includes a main body 102. The storage crate 100 is especially designed for stacking with like storage crates such as, for example, the another storage crate 100' shown in FIGS. 8-10 to form a stacked assembly 101. Like or similar structure of the storage crate 100 shown in FIGS. 1-7 may be identified with a same reference number but with a prime symbol (') with respect to the another storage crate 100' shown in FIGS. 8-14, for purpose of clarity.

In particular, as shown in FIGS. 1-14, each of the storage crate 100 and the another storage crate 100' may be provided with a repeating sequence 103 of lands 105 and channels 107 and also a matching shape 109 that corresponds with and is configured to be disposed adjacent the repeating sequence 103 of the lands 105 and the channels 107, as described further herein, when in the stacked assembly 101.

Without being bound to any particular theory, it is believed that a placement of the matching shape of the stackable storage crate relative to the repeating sequence 103 of lands 105 and channels 107 of the another stackable storage crate 100' militates against an undesirable lateral movement of the stackable storage crate 100 relative to the another stackable storage crate 100' in both a side-to-side direction and a forward-to-backward direction, while also permitting for easy in stacking of the stackable storage crates 100, 100' as described further herein with reference to method 200 in FIG. 15.

With renewed reference to FIGS. 1-14, the main body 102 of the storage crate 100 may be constructed using any durable, rigid material. As one non-limiting example, plastic may be used, and the plastic may be formed into the shape of the storage crate 100 by an injection-molding process. However, one skilled in the art may select any suitable materials and processes for fabricating the storage crate 100. In certain embodiments, the storage crate 100 has a substantially rectangular shape, as one non-limiting example. The storage crate 100 may also be any other suitable size and shape, as desired.

According to certain embodiments, shown in FIGS. 1-7, the main body 102 of the storage crate 100 may have a first side wall 104, a second side wall 106, a front wall 108, and a rear wall 110. The storage crate 100 may further include a bottom section 112 and an upper section 114, according to certain embodiments. The first side wall 104, the second side wall 106, the front wall 108, the rear wall 110, the bottom section 112, and the upper section 114 may be integrally formed with one another, separate components connected to one another, or a combination of the two.

As further depicted in FIGS. 1-7, one or more of the first side wall 104, the second side wall 106, the front wall 108, and the rear wall 110 may have a plurality of support panels 116 extending outwardly from the main body 102 of the storage crate 100. The support panels 116 may provide additional storage space, as well as structural support for the storage crate 100.

Figure 11:
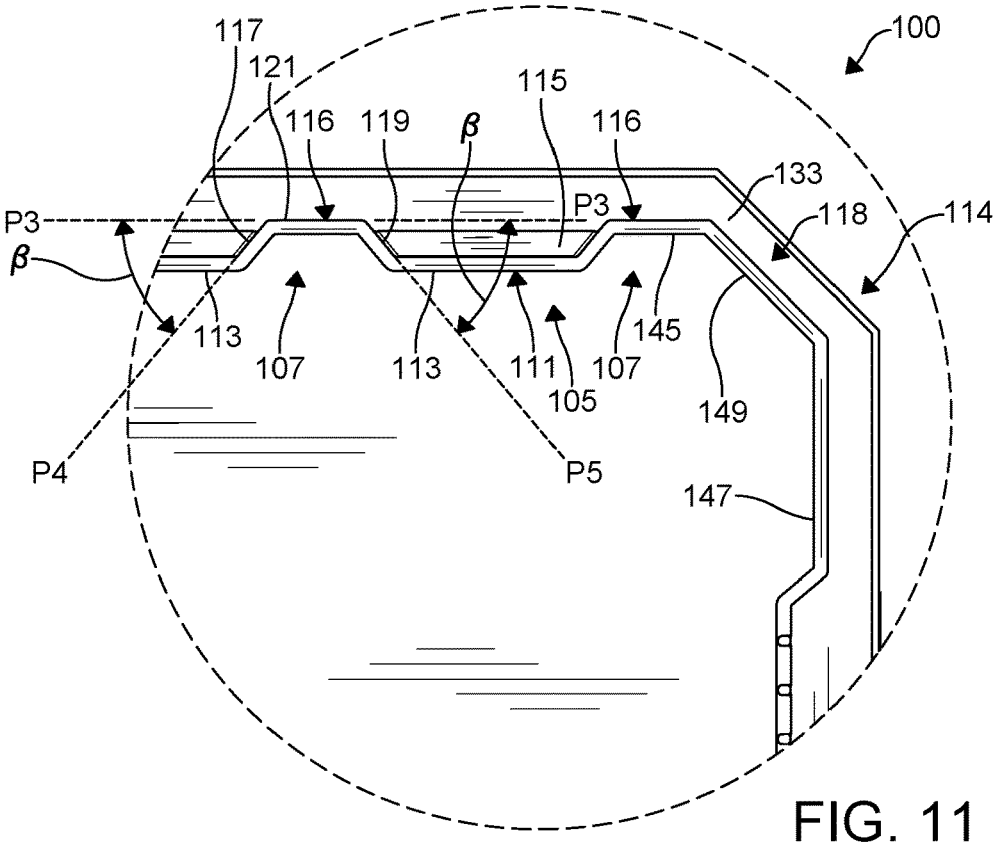
FIG. 11 is an enlarged, fragmentary, top plan view of the stackable storage crate taken at callout C in FIG. 3, and further illustrating a repeating sequence of lands and channels on an inner surface of a top section of the main body and a trapezoidal shape of a chamfered upper surface of an individual support panel.

It should be appreciated that the support panels 116 are also employed in the formation of the repeating sequence 103 of the lands 105 and the channels 107 of the main body 102. As illustrated in FIGS. 1 and 11, an inner surface 111 of the upper section 114 may be defined by the plurality of support panels 116. For example, the support panels 116 may be spaced apart substantially evenly along a length of each of the first side wall 104 and the second side wall 106, as shown in FIG. 1.

More particularly, as also shown in FIGS. 1 and 11, the support panels 116 may extend outwardly from each of the first side wall 104 and the second side wall 106 to form the channels 107 on the inner surface 111 of the upper section 114 of the main body 102. For example, as shown in FIGS. 1 and 11, an area 113 of the first side wall 104 and the second side wall 106 disposed between adjacent pairs of the support panels 116 may form the lands 105 on the inner surface 111 of the upper section 114 of the main body 102.

As also shown in FIGS. 1 and 11, a top lip 133 of the main body 102 may be defined by an uppermost surface of each of the first side wall 104, the second side wall 106, the front wall 108, and the rear wall 110 of the main body 102. Each of the support panels 116 further has a chamfered upper surface 115 that is disposed adjacent the top lip 133 of the upper section 114 of the main body 102.

As further illustrated in FIG. 14, the top lip 133 of the main body 102 may be disposed on a first plane P1, and the chamfered upper surface of each of the support panels is disposed on a second plane P2. The second plane P2 is disposed at a downward angle $\alpha$ relative to the first plane (P1). The downward angle $\alpha$ may be between about thirty degrees (30°) and seventy degrees (70°), and more particularly between about forty degrees (40°) and sixty degrees (60°), and most particularly about fifty degrees (50°). One of ordinary skill in the art may also select other suitable angles for the downward angle $\alpha$ within the scope of the present disclosure.

The chamfered upper surface 115 may also have a substantially trapezoidal shape, for example, as shown in FIG. 11. For example, each of the support panels 116 may have a substantially trapezoidal profile that defines the substantially trapezoidal shape of the chamfered upper surface 115. Each of the support panels 116 may have a first wall 117, a second wall 119, and a third wall 121. The third wall 121 connects the first wall 117 and the second wall 119. Each of the first wall 117, the second wall 119, and the third wall 121 is also connected to the chamfered upper surface 115, such that the chamfered upper surface 115 is bounded entirely by the first wall 117, the second wall 119, the third wall 121, and the top lip 133 of the main body 102, as shown in FIG. 11.

As further shown in FIG. 1, the first wall 117 may be disposed on a third plane P3, the second wall 119 may be disposed on a fourth plane P4, and the third wall 121 may be disposed on a fifth plane P5. Each of the fourth plane P4 and the fifth plane P5 may be oriented at an acute angle $\beta$ relative to the third plane P3, thereby defining the substantially trapezoidal profile and shape of the chamfered upper surface 115.

Without being bound to any particular theory, it is believed that the combination of the angle of the chamfered upper surface 115 and the substantially trapezoidal shape facilitates both an alignment and insertion of one of the storage totes 100 in the another of the storage totes 100' in operation to form the stacked assembly 101.

Figure 2:
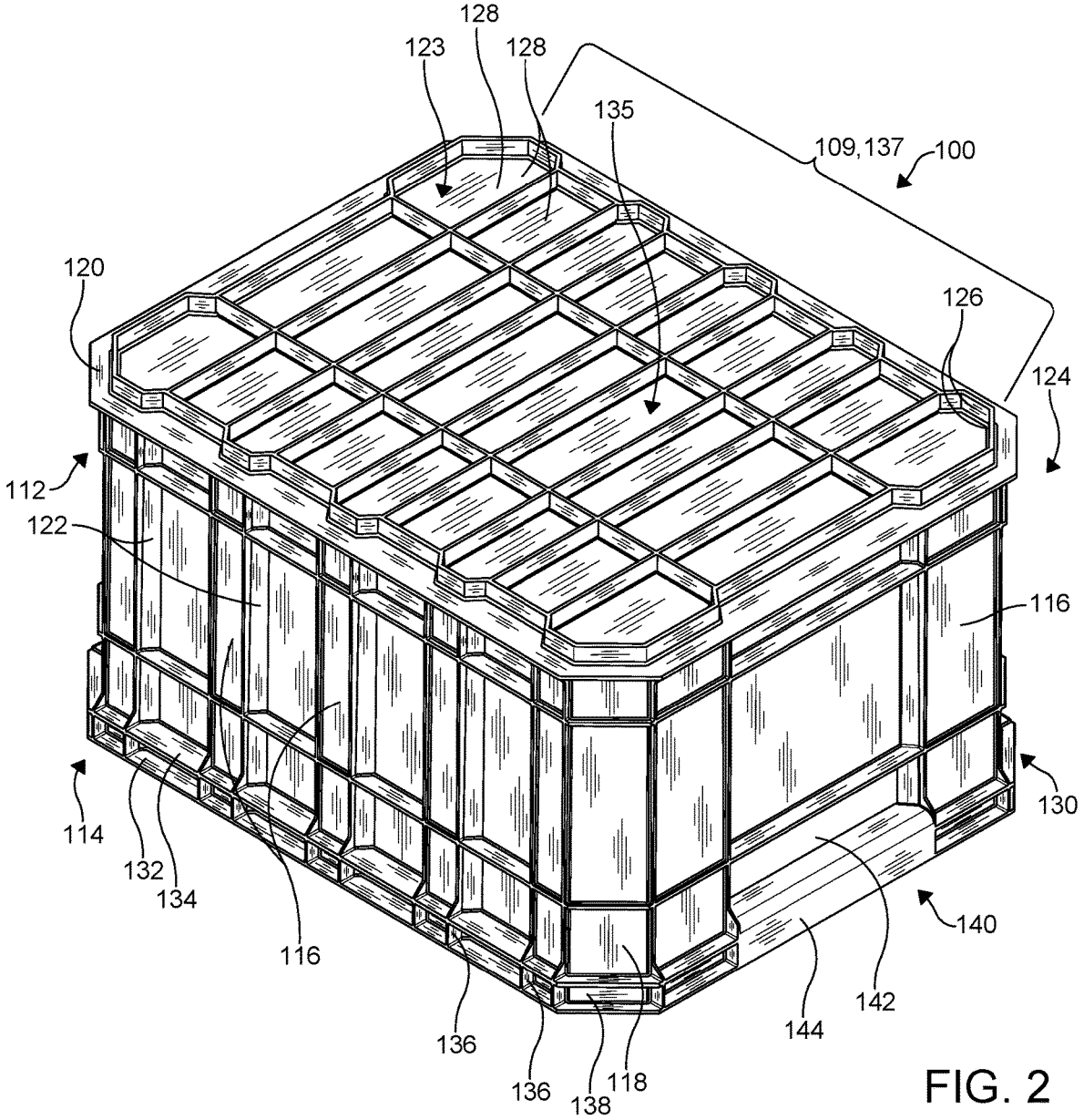
Figure 12:
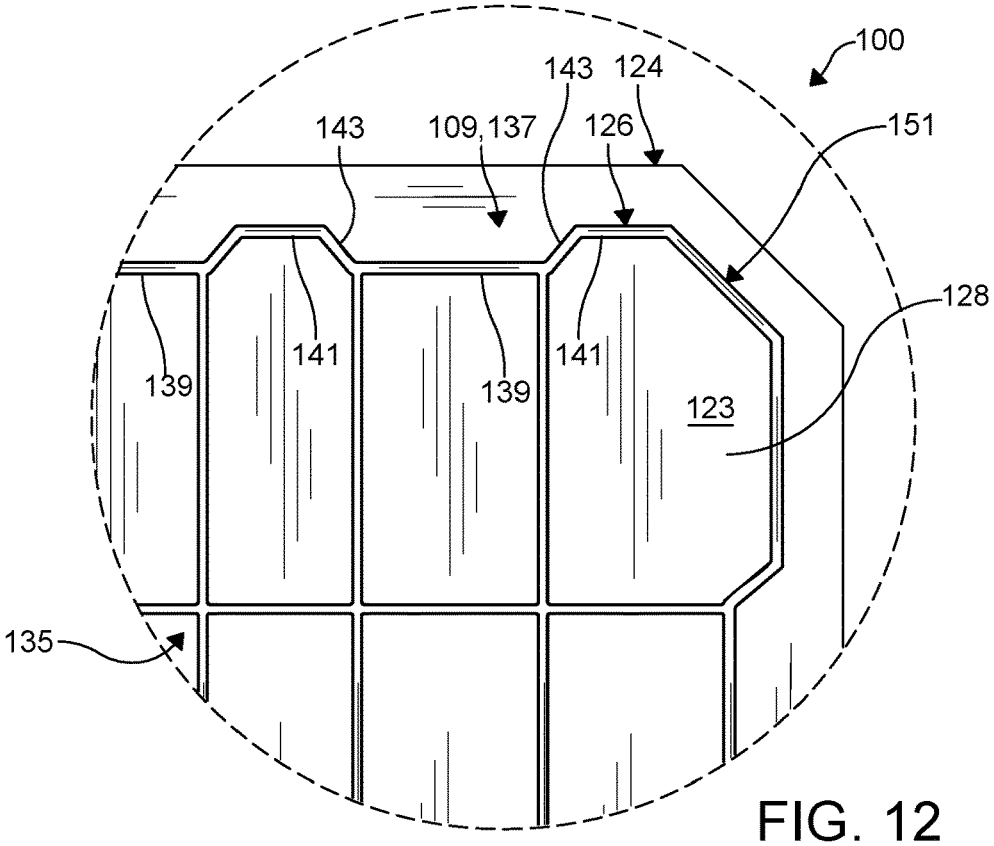
FIG. 12 is an enlarged, fragmentary, bottom plan view of the stackable storage crate taken at callout D in FIG. 4, and further illustrating a matching shape in the form of a ridge that corresponds with and is configured to be disposed adjacent the repeating sequence of lands and channels of the inner surface of another stackable storage crate when in a stacked assembly.

Referring now to FIGS. 2 and 12 the bottom section 112 may include a bottom wall 123 having a ridge 126. The ridge 126 of the bottom section 112 may be disposed on a bottom surface 128 of the bottom wall 123 of the main body 102, and extend downwardly from the bottom surface 128 of the bottom wall 123. In particular examples, the ridge 126 is continuous and circumscribes a central area 135 of the bottom surface 128 of the bottom wall 123.

As shown in FIG. 2, the ridge 126 defines the matching shape 109 that corresponds with and is configured to be disposed adjacent the repeating sequence 103 of the lands 105 and the channels 107 of the inner surface 111 of the another stackable storage crate 100' when in the stacked assembly 101. In particular, the matching shape 109 may be provided by a repeating sequence 137 of inner walls 139 and outer walls 141 connected by angled walls 143, as shown in FIG. 12. When in the stacked assembly 101, as shown in FIG. 13, each of the outer walls 141 of the ridge 126 may be configured to be disposed adjacent the third wall 121 of one of the support panels 116 of the another stackable storage crate 100'. Likewise, as also shown in FIG. 13, each of the inner walls 139 is configured to be disposed between one of the adjacent pairs of the support panels 116 of the another stackable storage crate 100' when in the stacked assembly 101.

In certain embodiments, the support panels 116 also form a plurality of corner sections 118 in the main body 102 of the storage crate 100. In the embodiment of the present disclosure, as seen in FIGS. 1 and 11, the corner sections 118 are disposed at an angle relative to and joining the first side wall 104, second side wall 106, front wall 108, and rear walls 110. In particular, the plurality of corner sections 118 join the first side wall 104 and the second side wall 106 to the front wall 108 and the rear wall 110.

For example, as shown in FIG. 11, each of the corner sections 118 has a first inner surface 145, a second inner surface 147, and a third inner surface 149. The third inner surface 149 connects the first inner surface 145 and the second inner surface 147. As shown in FIG. 12, the ridge 126 has a plurality of matching corners 151. Each of the matching corners 151 corresponds with and is configured to be disposed adjacent one of the corner sections 118 of the another stackable storage crate 100' when in the stacked assembly 101. In particular, the first inner surface 145 of each of the corner sections 118 is configured to be disposed adjacent one of the outer walls 141 of the ridge 126 when in the stacked assembly 101. It should be appreciated that the corner section 118 having the three (3) inner surfaces 145, 147, 149 together with the matching corners 151 of the ridge 126 facilitate for a more stable stacking of the storage totes 100, 100' and militate against undesirable moving in a side-to-side direction and a forward-to-backward direction while stacked.

Advantageously, there is also a consistent gap G as shown in FIGS. 13 and 14 in the stacked assembly 101. The consistent gap G is between an entirety of the inner surface 111 of the upper section 114 of the main body of the stackable storage crate 100 and the ridge 126 of the bottom section 112 of the another stackable storage crate 100' when the crates 100, 100' are aligned and in the stacked assembly 100. The consistent gap G may be between 0.1 mm and 2 mm, more particularly between 0.5 mm and 1.5 mm, and most particularly about 1 mm. The presence of the consistent gap G means that there is no friction fit between the stackable storage crates 100, 100' in the stacked assembly 101. Other suitable dimensions for the consistent gap G may also be employed by a skilled artisan within the scope of the disclosure.

It should be appreciated that the presence of the consistent gap G permits for the nesting of the stackable storage crates 100, 100' in the stacked assembly 101 while minimizing movement in the side-to-side direction and the forward-to-backward direction, and also while permitting for ease in unstacking the stackable storage crates 100, 100' due to the absence of the friction fit between the stackable storage crates 100, 100' in the stacked assembly 101.

In certain embodiments, the support panels 116 are disposed in a repeating sequence on the first side wall 104, and second side wall 106, and together the matching shape 109 has a substantially saw-toothed pattern.

A plurality of horizontal supports 120 may be disposed adjacent one or more of the first side wall 104, the second side wall 106, the front wall 108, and the rear wall 110, according to certain embodiments. The horizontal supports 120 may be ledges extending outwardly from the main body 102 of the storage crate 100 between some or each of the support panels 116, as one non-limiting example. Any number of additional suitable supports may be disposed between the upper section 114 and bottom section 112 to increase stability of the storage crate 100, as determined by one of skill in the art. In certain embodiments, as seen in FIGS. 1, and 2, a first horizontal support 132, and underneath, a second horizontal support 134 may form the upper section 114 of the main body.

Figure 7:
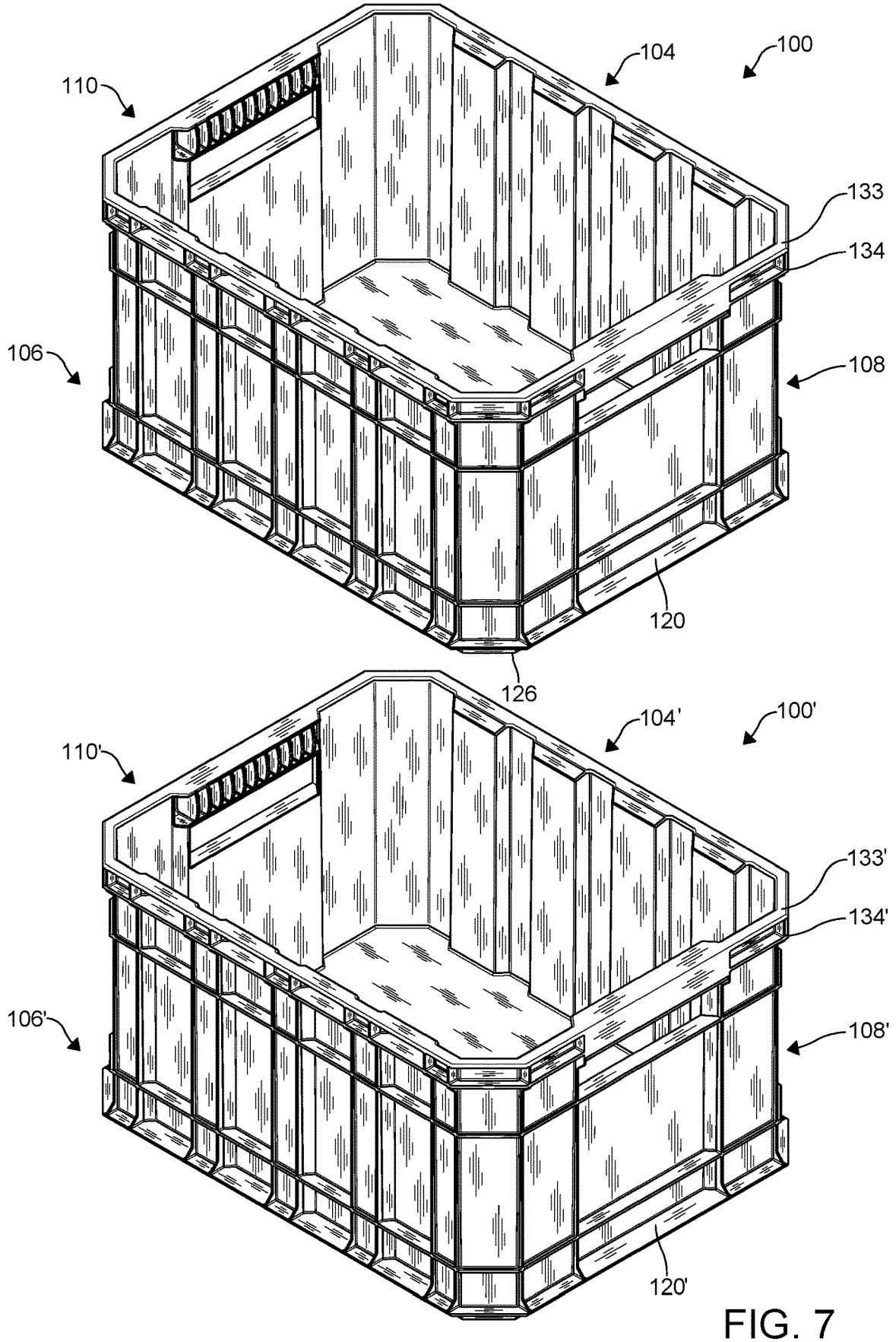
FIG. 7 is a top perspective view of a pair of the stackable storage crates shown in FIG. 1, and depicted spaced apart from one another oriented prior to stacking.

With continued reference to FIGS. 1, and 2, the upper section 114 may form a portion of the first side wall 104, the second side wall 106, the front wall 108, and the rear wall 110, or may be a separate component adjacent a top end 130 of each of the first side wall 104, the second side wall 106, the front wall 108, and the rear wall 110, or may be a combination of the two. In certain more particular embodiments, as shown in FIGS. 1, and 2, the upper section 114 may include a first horizontal support 132 and a second horizontal support 134 below the first horizontal support 132. The first horizontal support 132, also may form the top lip 133, at the top end 130 of each the first side wall 104, second side wall 106, front wall 108, and rear walls 110, as seen in FIG. 7. The second horizontal support 134 may be disposed adjacent each of the first side wall 104, the second side wall 106, the front wall 108, and the rear wall 110 and extend outwardly from the main body 102 of the storage crate 100. The upper section 114 may also include one or more upper section vertical supports 136 extending from the first horizontal support 132 to the second horizontal support 134, as desired. The upper section 114, according to certain embodiments, may include upper section corner sections 138.

Figure 5:
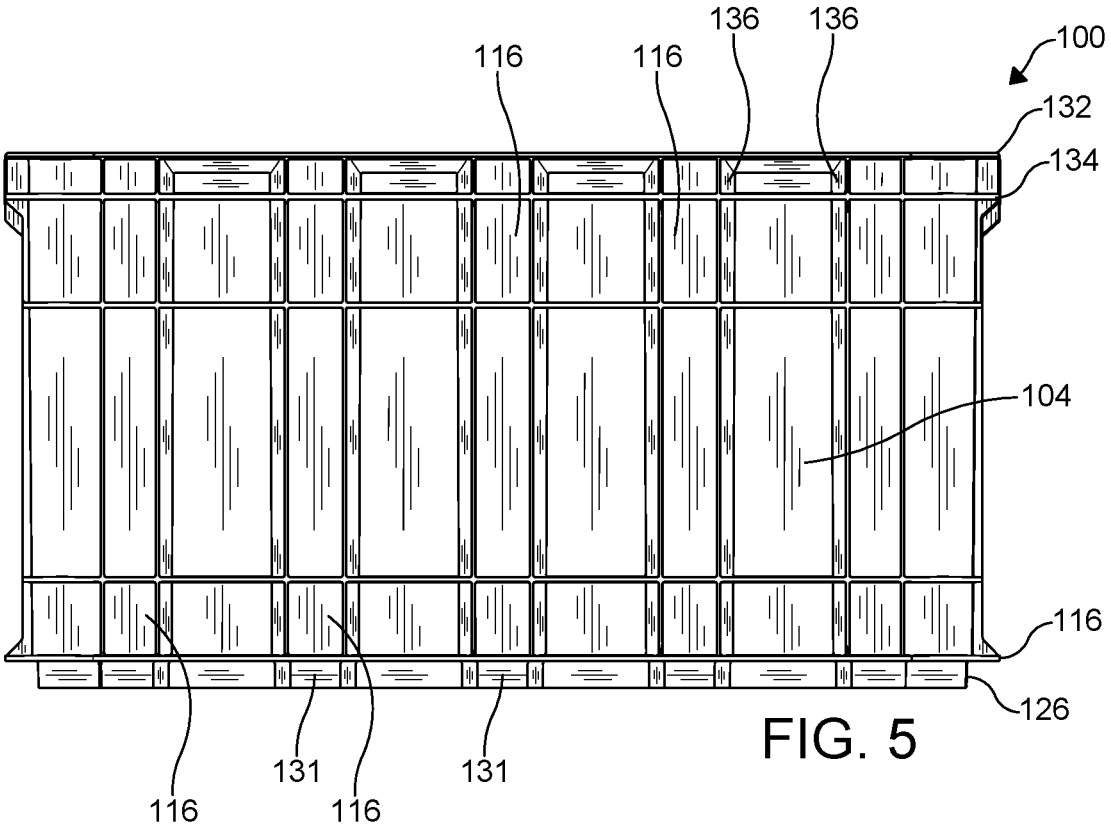
FIG. 5 is a right side elevational view of the stackable storage crate shown in FIG. 1.

A plurality of vertical supports 122 may also be disposed on the main body 102 of the storage crate 100. The vertical supports 122 may extend downwardly from the upper section 114 of the main body 102 along one or more of the first side wall 104, the second side wall 106, the front wall 108, and the rear wall 110. The vertical supports 122 may extend outwardly from the first side wall 104, the second side wall 106, the front wall 108, and the rear wall 110, according to certain embodiments. In certain embodiments, the vertical supports 122 may extend from the upper section 114 to the bottom section 112 of the storage crate 100. In certain embodiments, the vertical supports 122 may also be disposed on one or more of the corner sections 118 of the storage crate 100. In a certain embodiment, as seen in FIG. 5, the vertical supports 122 are disposed at regular intervals, and in a most particular embodiment, vertical supports 122 are disposed in a repeating pattern at the vertical edges of each support panel 116.

The bottom section 112 of the storage crate 100 may be a flat, rigid surface disposed adjacent a bottom end 124 of each of the first side wall 104, the second side wall 106, the front wall 108, and the rear wall 110. The bottom section 112, according to certain more particular embodiments, may include the bottom section ridge 126 extending downwardly away from the bottom surface 128 of the bottom section 112 of the storage crate 100. The bottom section ridge 126 may be an outwardly extending protrusion or wall having any desired shape and size. The bottom section ridge 126 may be continuous, as shown in FIG. 4, or broken up in sections (not shown).

Figure 3:
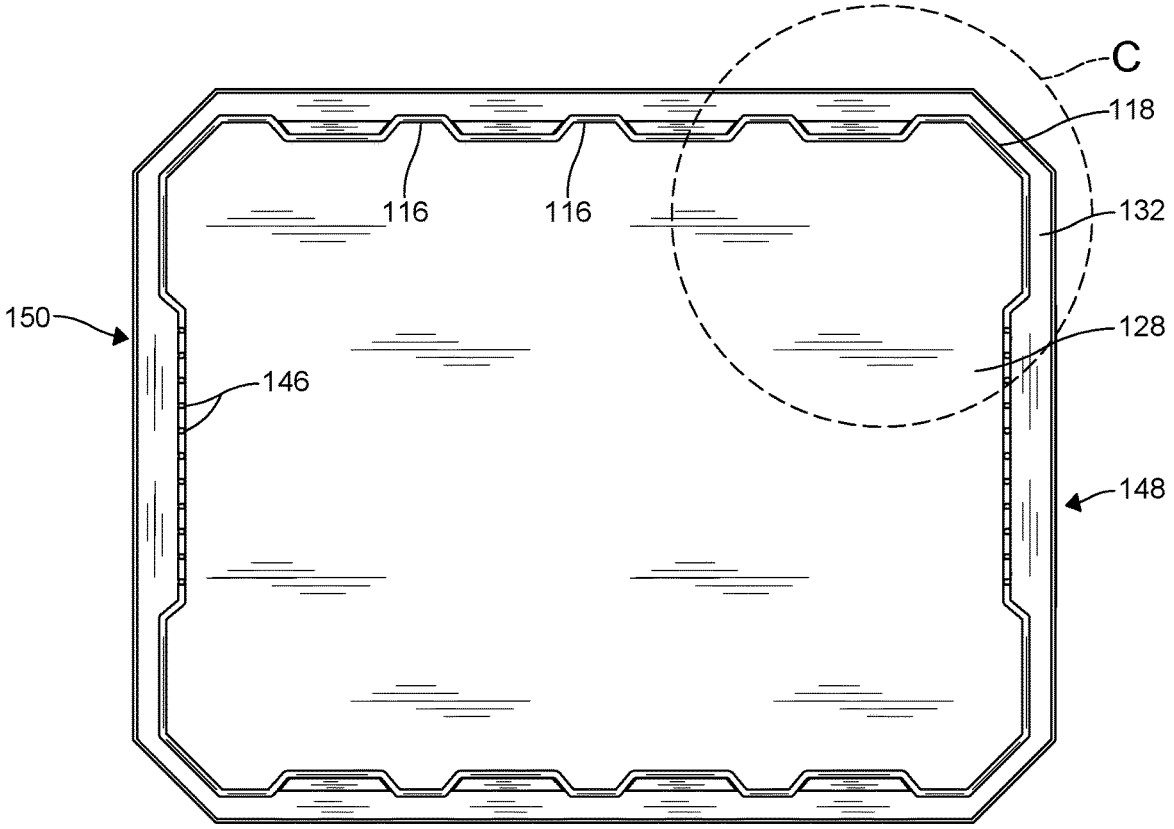
FIG. 3 is a top plan view of the stackable storage crate shown in FIG. 1.
Figure 4:
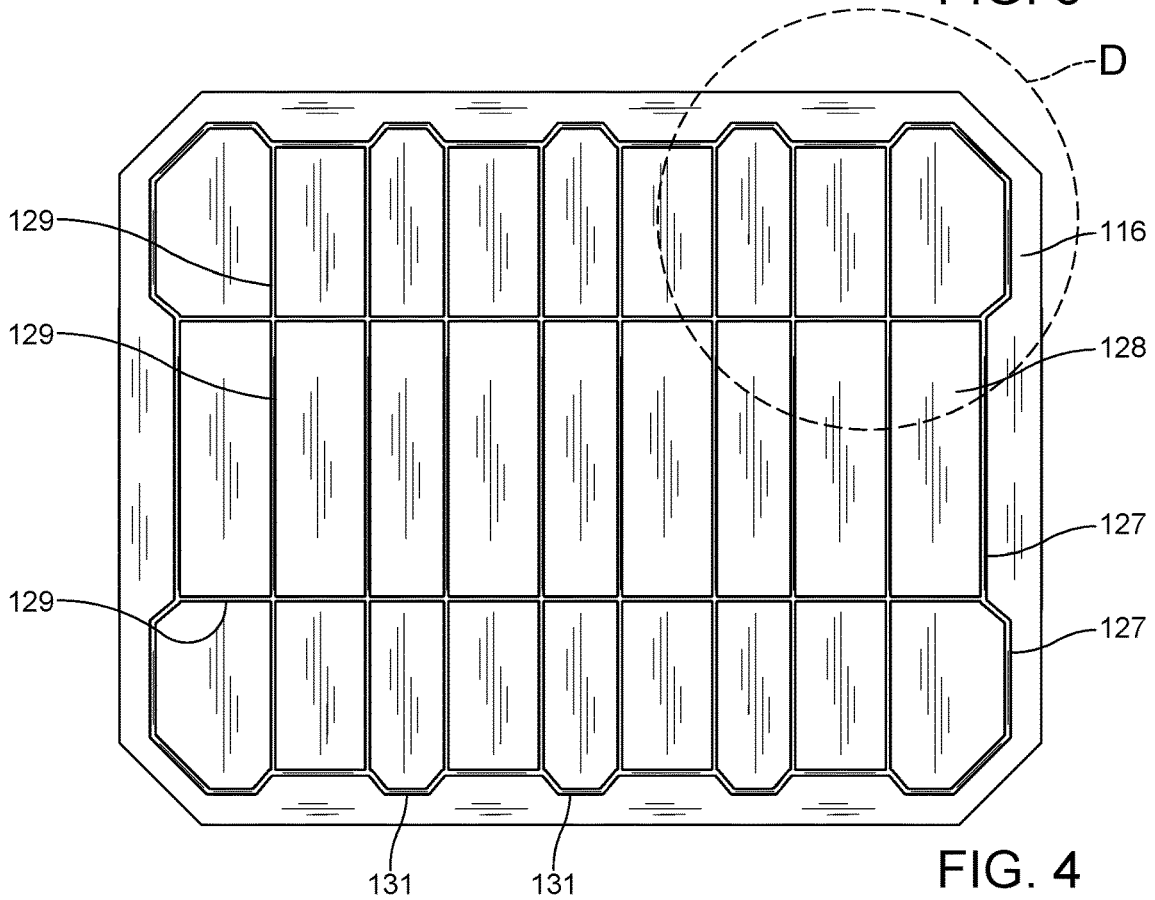
FIG. 4 is a bottom plan view of the stackable storage crate shown in FIG. 1.
Figure 8:
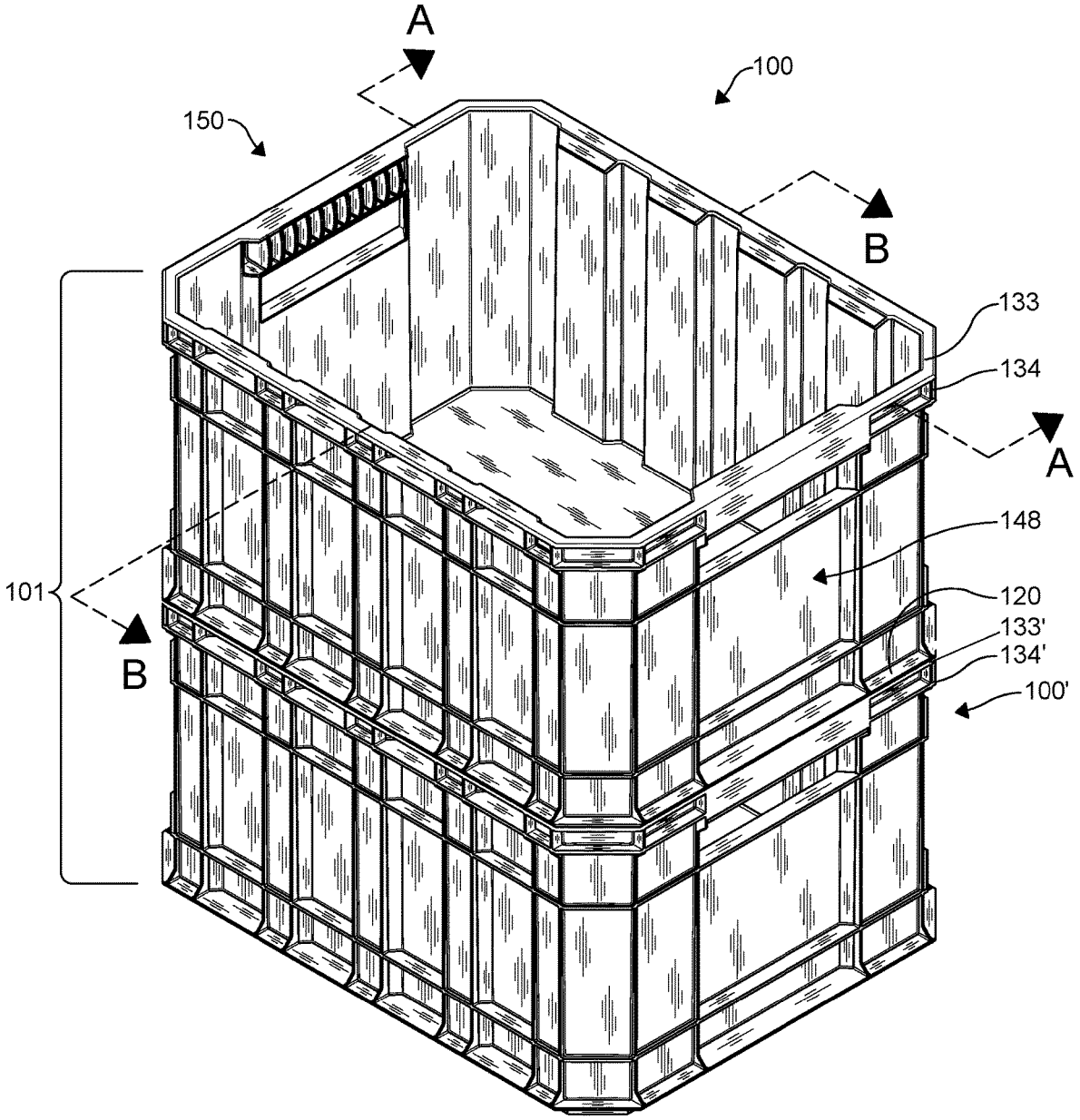
FIG. 8 is a top perspective view of the pair of stackable storage crates shown in FIG. 7, and depicted stacked together.

In certain embodiments as shown in FIG. 4, the bottom section ridge 126 has an outer ridge 127, and inner connecting ridges 129 that connect to the outer ridge 127. The inner connecting ridges 129 may traverse the bottom surface 128 in a continuous grid-like configuration, as one non-limiting formation. In a preferred embodiment, as seen in FIGS. 3, and 4, the outer ridge 127 is contoured with a plurality of protrusions 131 forming the shape 109, that corresponds to the a repeating sequence 103 of lands 105 and channels 107 formed by the support panels 116 as disposed on the first side wall 104, second side wall 106, front wall 108, and rear walls 110, such that when a first storage crate 100, is stacked onto a second storage crate 100', the protrusions 131 of the outer ridge 127 of the first storage crate nest and abut the support panels 116 of the second storage crate 100', as shown in FIGS. 8-10, thus providing support to the stacked assembly 101 of the crates 100, 100' by limiting horizontal movement between the he crates 100, 100', somewhat locking the first storage crate 100 onto the second storage crate 100'.

Figure 6:
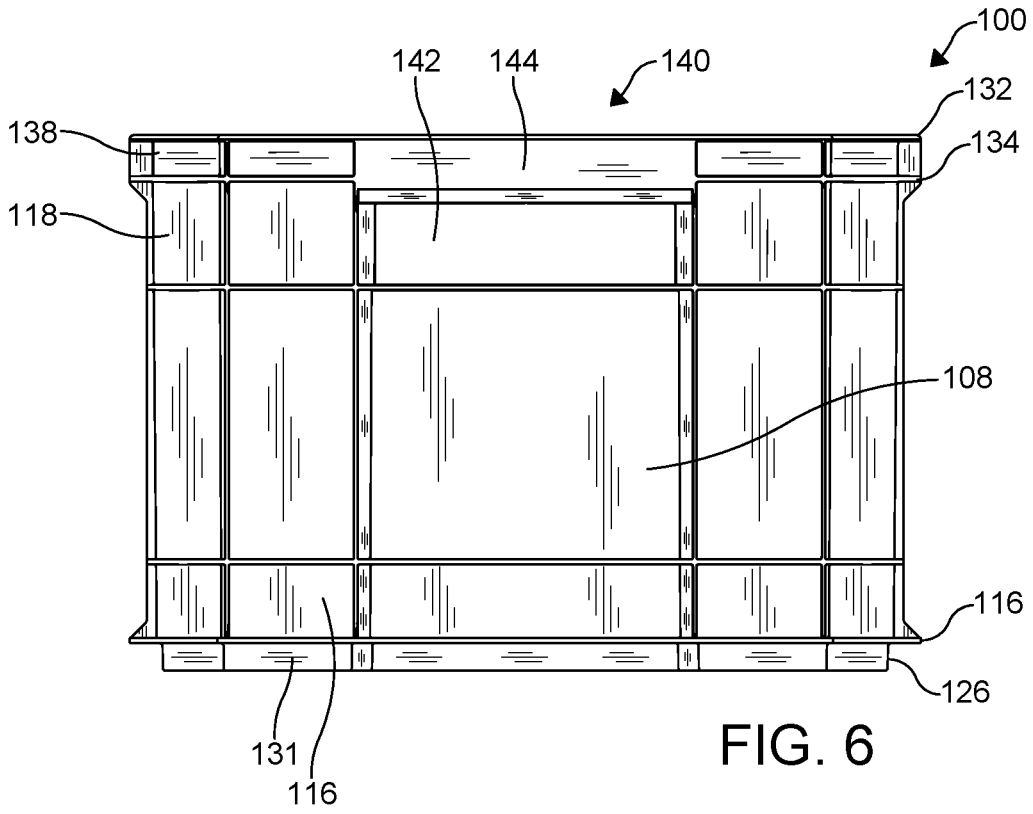
FIG. 6 is a front side elevational view of the stackable storage crate shown in FIG. 1.

In some embodiments, the main body 102 may include at least one handle 140. The handle 140 may be formed in at least one of the first side wall 104, the second side wall 106, the front wall 108, and the rear wall 110. In certain embodiments, as shown in FIGS. 1, 2 and 6, the handle 140 may be formed in the upper section 114 of the storage crate 100. The handle 140 may be integral with or connected to the main body 102 of the storage crate 100. The handle 140 may be any ergonomic size and shape suitable for allowing a user to tightly grasp and transport the storage crate 100, as needed.

In particular embodiments, as shown in FIGS. 1, 2, and 6, at least one opening 142 may be formed adjacent the handle 140 in one or more of the first side wall 104, the second side wall 106, the front wall 108, and the rear wall 110. The opening 142 may be any suitable shape and size allowing a user to insert a hand through the opening 142 to easily grasp the handle 140.

With continued reference to FIGS. 1-2 and 6-7, the upper section 114 of the main body 102 may form a portion of the handle 140 in combination with one or more of the first side wall 104, the second side wall 106, the front wall 108, and the rear wall 110. The handle 140 may have a hollow section 144 extending from the first horizontal support 132 to the second horizontal support 134 of the upper section 114, according to certain embodiments. The hollow section 144 may include a plurality of support ridges 146 extending from the first horizontal support 132 to the second horizontal support 134. The support ridges 146 may be adapted to provide additional support to the handle 140 during lifting and transport of the storage crate 100.

In certain more particular embodiments, with renewed reference to FIGS. 1 and 7, a first handle 148 and a second handle 150 may be disposed on opposite sides of the of the main body 102 of the storage crate 100. In one example, the first handle 148 may be disposed in the front wall 108, and the second handle may be disposed in the rear wall 110. Each of the first handle 148 and the second handle 150 are formed centrally in the upper section 114 of the main body 102 and have the hollow section 144 with the opening 142 beneath the hollow section 144 to accommodate lifting by hand. The hollow section 144 further may have the plurality of support ridges 146 spaced apart along a length of the hollow section 144. The support ridges 146 further extend vertically between the top lip 133 and the opening 142 beneath the hollow section 144. In use, the first handle and the second handle 148, 150 may be configured to provide an ergonomic location for a user to lift the main body 102 of the storage crate 100. Likewise, the opening 142 may be configured to accommodate lifting a storage crate 100 by hand, as a non-limiting configuration. One skilled in the art may select any type and number of handles 140 disposed on any portion of the storage crate 100, within the scope of the present disclosure.

The first storage crate 100 may be stacked on top of the second storage crate 100', in the stacked assembly 101. The support panels 116, the horizontal supports 120, the vertical supports 122, the corner sections 118, and the upper section corner sections 138 are adapted to provide additional support to the first storage crate 100, and to the stacked assembly 101 of the first and second storage crates 100, 100' when stacked. As shown in FIG. 7-10, when the first storage crate 100 is stacked on the second storage crate 100', the first storage crate 100 has the bottom surface 128 resting on the top lip 133' of the second storage crate 100'.

As shown in FIG. 10, the second storage crate 100' also has a plurality of support panels 116' disposed on each of a first side wall 104', a second side wall 106', a front wall 108', and a rear wall 110', together defining an inner surface 111'. Each of the support panels 116' may have a chamfered upper surface 115' that is disposed adjacent the top lip 133' of the second storage crate 100', for example, as shown in FIG. 14. The second storage crate 100' may also have a plurality of horizontal supports 120' including a second horizontal support 134' disposed on each the first side wall 104', the second side wall 106', the front wall 108', and the rear wall 110'. As shown in FIG. 10, the second storage crate 100' may also have a bottom section ridge 126' extending downwardly from a bottom surface 128'. To facilitate stacking with the first storage crate 100, the ridge 126' of the second storage crate 100' may be formed with protrusions 131' that correspond to the repeating sequence 103 of the lands 105 and the channels 107 formed by the support panels 116 of the first storage crate 100.

In a particular embodiment, the first storage crate 100 outer ridge 127 is configured with protrusions 131, that nest with and abut the support panels 116 of the second storage crate 100' when stacked, for example, as seen in FIGS. 3-4, and 9-10. Accordingly, the first storage crate 100 and second storage crate 100' each have optimal support and stability when stacked, due to the partially nested configuration of stacked crates, which limits side-to-side, and front-to-rear shifting, or sliding between the first and second storage crates, 100, 100'.

The present disclosure further includes the method 200 of forming the stacked assembly 101 of the storage crates 100, 100', as shown in FIG. 15. The method 200 includes a first step 202 of providing the stackable storage crate 100 and the another stackable storage crate 100' as described hereinabove. Next, the method 200 includes a second step 204 of aligning the stackable storage crate 100 with the another stackable storage crate 100'. The method 200 further includes a third step 206 of disposing the stackable storage crate 100 on the another stackable storage crate 100' such that the stackable storage crate 100 abuts the another stackable storage crate 100'. The matching shape 109 of the ridge 126 of the stackable storage crate 100 corresponds with and is disposed adjacent the repeating sequence 103 of the lands 105 and the channels 107 of the inner surface 111 of the another stackable storage crate 100' when disposed thusly. It should be appreciated that the placement of the ridge 126 of the stackable storage crate 100 relative to the inner surface 111 of the upper section 114 of the another stackable storage crate 100' militates against lateral movement of the stackable storage crate 100 relative to the another stackable storage crate 100' in both the side-to-side direction and the forward-to-backward direction upon the stacked assembly 101 being assembled according to the method 200 of the present disclosure.

Advantageously, the stackable storage crate 100, 100' as described herein is durable and can be easily stored and transported in stacked formations in combination with other storage crates 100, 100'. Further, the stackable storage crate 100, 100' is constructed with a main body 102 configured to support stable stacking, with extra support of the main body 102, and durable handles 140, 148, 150 as described, Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions, and methods can be made within the scope of the present technology, with substantially similar results.

What is claimed is:

1. A stackable storage crate, comprising:

a main body having a first side wall, a second side wall, a front wall, and a rear wall, an upper section, and a bottom section, the upper section having a top lip and an inner surface with a repeating sequence of lands and channels, and the bottom section having a ridge with a plurality of alternating inset wall portions and projecting wall portions, the plurality of alternating inset wall portions and projecting wall portions correspond to the lands and channels such that when the stackable storage crate is stacked atop a second crate identical to the stackable storage crate then the inset wall portions of the stackable storage crate are adjacent the lands of the second crate and the projecting wall portions of the stackable storage crate are adjacent the channels of the second crate;

wherein the repeating sequence of lands and channels of the inner surface of the upper section is defined by a plurality of support panels, the support panels spaced apart along a length of each of the first side wall and the second side wall;

wherein the support panels extend outwardly from each of the first side wall and the second side wall to form the channels on the inner surface of the upper section of the main body;

wherein an area of the first side wall and the second side wall disposed between adjacent pairs of the support panels form the lands on the inner surface of the upper section of the main body; and wherein the top lip of the main body is defined by an uppermost surface of each of the first side wall, the second side wall, the front wall, and the rear wall of the main body, and each of the lands has a chamfered upper surface that is disposed adjacent the top lip of the upper section of the main body.

2. The stackable storage crate of claim 1, wherein the top lip of the main body is disposed on a first plane, and the chamfered upper surface of each of the lands is disposed on a second plane, the second plane disposed at a downward angle relative to the first plane.

3. The stackable storage crate of claim 2, wherein each of the lands has a substantially trapezoidal profile including a first wall, a second wall, and a third wall, the third wall connecting the first wall and the second wall, and each of the first wall, the second wall, and the third wall connected to the chamfered upper surface, and the chamfered upper surface is bounded entirely by the first wall, the second wall, the third wall, and the top lip of the main body.

4. The stackable storage crate of claim 3, wherein the ridge of the bottom section is disposed on a bottom wall of the main body, and extends downwardly from a bottom surface of the bottom wall.

5. The stackable storage crate of claim 4, wherein the ridge is continuous and circumscribes a central area of the bottom surface of the bottom wall.

6. The stackable storage crate of claim 5, wherein the main body has a plurality of corner sections that join the first side wall and the second side wall to the front wall and the rear wall.

7. The stackable storage crate of claim 6, wherein each of the corner sections has a first inner surface, a second inner surface, and a third inner surface, the third inner surface connecting the first inner surface and the second inner surface.

8. The stackable storage crate of claim 7, wherein the ridge has a plurality of matching corners, each of the matching corners corresponds with and is configured to be disposed adjacent one of the corner sections of the second crate when the stackable storage crate is stacked atop the second crate.

9. The stackable storage crate of claim 8, wherein the first inner surface of each of the corner sections is configured to be disposed adjacent one of the projecting wall portions of the second crate when the second crate is stacked atop the stackable storage crate.

10. The stackable storage crate of claim 1, wherein there is a consistent gap between the entirety of the inner surface of the upper section and the ridge of the bottom section when the stackable storage crate and the second crate are aligned and the stackable storage crate is stacked atop the second crate.

11. The stackable storage crate of claim 1, further comprising a first handle and a second handle disposed opposite each other, the first handle disposed in the front wall, and the second handle disposed in the rear wall, and each the first handle and the second handle are formed centrally in the upper section of the main body and have a hollow section with an opening beneath the hollow section to accommodate lifting by hand, and the hollow section has a plurality of support ridges spaced apart along a length of the hollow section and extending vertically between the top lid and the opening beneath the hollow section.

* * * * *